United States Patent [19]

Wolters

[11] 4,018,415

[45] Apr. 19, 1977

[54] MECHANISM FOR TILTING CHAIRS

[75] Inventor: Richard H. Wolters, Grand Rapids, Mich.

[73] Assignee: Herman Miller, Inc., Zeeland, Mich.

[22] Filed: Jan. 13, 1976

[21] Appl. No.: 648,793

[52] U.S. Cl. ..... 248/381; 248/397; 248/382; 297/304

[51] Int. Cl.² ..... A45D 19/04; F16M 13/00

[58] Field of Search ..... 248/371–375, 248/378–385, 397; 297/301–305, 325–328

[56] References Cited

UNITED STATES PATENTS

| | | | |
|---|---|---|---|
| 170,561 | 11/1875 | Heywood | 248/382 |
| 555,694 | 3/1896 | Gilson | 248/380 |
| 729,571 | 6/1903 | Germanson | 248/380 |
| 1,866,498 | 7/1932 | Bolens | 248/380 |
| 2,082,499 | 6/1937 | Keyworth | 248/380 |
| 2,447,283 | 8/1948 | Sheldrick | 248/381 |
| 2,518,817 | 8/1950 | Ries | 248/168 |
| 2,558,049 | 6/1951 | Hersey et al. | 248/384 X |
| 2,619,153 | 11/1952 | Van Osselen | 297/302 |
| 3,480,249 | 11/1969 | Lie | 248/373 |

FOREIGN PATENTS OR APPLICATIONS

| | | | |
|---|---|---|---|
| 456,600 | 2/1928 | Germany | 248/381 |
| 639,350 | 5/1962 | Italy | 248/381 |
| 1,168,180 | 10/1969 | United Kingdom | 248/384 |
| 1,386,804 | 3/1975 | United Kingdom | 297/328 |

*Primary Examiner*—Lawrence J. Staab
*Attorney, Agent, or Firm*—Price, Heneveld, Huizenga & Cooper

[57] ABSTRACT

A tilting chair support mechanism is provided including a spindle support, a pivotally mounted tilt plate and an encapsulated spring acting between the support and the tilt plate biasing the plate into a forwardly or return tilted position. The spring is mounted within the side silhouette of the plate. The mechanism is so designed that the plate can be released for full forward pivotal tilting in which position, the spring is released for removal or replacement. Means are provided for limiting the forward pivotal movement of the plate when the chair is in normal use. Provision is made for adjustment of the preload applied to the encapsulated spring.

13 Claims, 6 Drawing Figures

MECHANISM FOR TILTING CHAIRS

CROSS-REFERENCE TO RELATED APPLICATION

This application is related to patent application Ser. No. 648,812, filed on Jan. 13, 1976 by William E. Stumpf and Richard H. Wolters assigned to the assignee of this application. William E. Stumpf and Richard H. Wolters are the inventors of the means by which the tilt plate can be optionally limited by the user to either of two maximum forwardly tilted positions. The claimed subject matter of this application is the specific means for providing a resilient forwardly tilting bias to the tilt plate.

BACKGROUND OF THE INVENTION

This invention relates to tiltable chair arrangements and, more particularly it concerns a coil spring tilt mechanism disposed between a support base and the bottom of a chair.

Different forms of chair tilt mechanisms are known in the prior art. For example, tilt mechanisms incorporating a torsion bar arrangement to impart a return bias or torque to a chair have been proposed. Generally, these mechanisms have suffered from bulkiness and distracting operating characteristics. The bulkiness prevents the torsion bar mechanism from being readily adapted to the overall design of the chair thereby presenting a "mechanical" or clumsy appearance. Although torsion bar mechanisms do have linear or straight line performance characteristics, the ride given to the user of the chair may be hampered by a feel of friction and stickiness.

Tilt mechanisms employing a rubber pack-type resilient element are also known. These rubber packed mechanisms do overcome the feel of stickiness and friction from which torsion bar mechanisms have suffered. However, due to the non-linear characteristics of the rubber packed devices, a bouncy or "rubbery" feel is imparted to the user of the chair. This rubbery feel is usually more prevalent when the user of the chair is of a relatively low weight. With users having higher weights, the rubbery feeling due to the non-linear characteristics of the device decreases.

Various tilt mechanisms employing coil springs to impart the return torque have also been used. The coil springs, due to their straihgt line performance or linear characteristics generally provide a smoother and more comfortable ride when compared with tilt mechanisms employing either a torsion bar or a rubber pack. The feel of friction and stickiness is minimized or nearly eliminated.

However, coil spring devices have generally suffered from bulkiness and high weight. An exposed coil spring device is prone to the collection of dirt and dust, is very difficult to clean and is not easily adjustable to the needs of persons of different physical characteristics. Further, present coil spring tilt mechanisms do not have provision for the ready substitution of springs of different compression values.

Although coil springs may be preloaded to thereby require a greater initial force to be imparted to the chair by a user, due to the coil spring's linear characteristics, the incremental increase in force required to tilt the chair remains the same. As a result, one spring may provide an acceptable ride or degree of resistance to tilt for a person of relatively low weight while imparting to a person of relatively higher weight a feeling of looseness or instability. As a result, to completely tailor a chair to the individual user, the ability to substitute springs of different compression values is desirable.

SUMMARY OF THE INVENTION

In accordance with the present invention, an improved tilt mechanism for a chair is provided possessing the qualtities of compactness, adaptability to a wide variety of the population and to different uses, smoothness of operation, ease of maintenance, ease of adjustment, long life and relatively low cost. Essentially, the tilt mechanism of the present invention includes a tilt plate pivotally supported on a support spindle or post. The support spindle includes a trifurcated end, the forks of which are formed with apertures through which is pivot pin extends and upon which the tilt plate is pivotally supported.

The tilt plate includes a centrally disposed, longitudinally extending slot. The center prong or fork of the trifurcated post extends upwardly through the slot and serves as a stop finger. The stop finger is formed with an upper and a lower stop socket on one face. A pivotable latch carried by the tilt plate cooperates with the stop finger to provide an initial position for the tilt mechanism.

A return torque imparting element is disposed between the opposite face of the stop finger and one end of the pivot plate. The return torque imparting element includes a plastic encapsulated coil having one end received by a semi-spherical nose formed as part of the stop finger and serving as a pivot point for the encapsulated spring. The opposite end of the spring abuts a support block, the block may be moved longitudinally with respect to the tilt plate by a threaded stud and knurled adjustment nut arrangement.

By rotating the chair backwardly and pivoting the latch so that it is disengaged from the stop, the tilt plate and seat is free to pivot past its normal of forward position. The encapsulated spring may then be readily removed and replaced by a spring having a different spring rate.

Among the objects of the present invention therefor are: the provision of an improved tilt mechanism for a chair possessing simplicity and compactness, thereby, being capable of blending in with the design of the chair to avoid a "mechanical" appearance; the provision of an improved tilt mechanism employing an encapsulated spring readily adjustable for initial preload; the provision of a tilt mechanism for a chair permitting ready substitution of the encapsulated coil springs with a spring having a higher or lower spring compression value; and the provision of an improved tilt mechanism for a chair of the type referred to by which the problems heretofore experienced with tiltable chairs are substantially alleviated.

DETAILED DESCRIPTION OF THE PREFERRED EMBODIMENT

Figure 2:
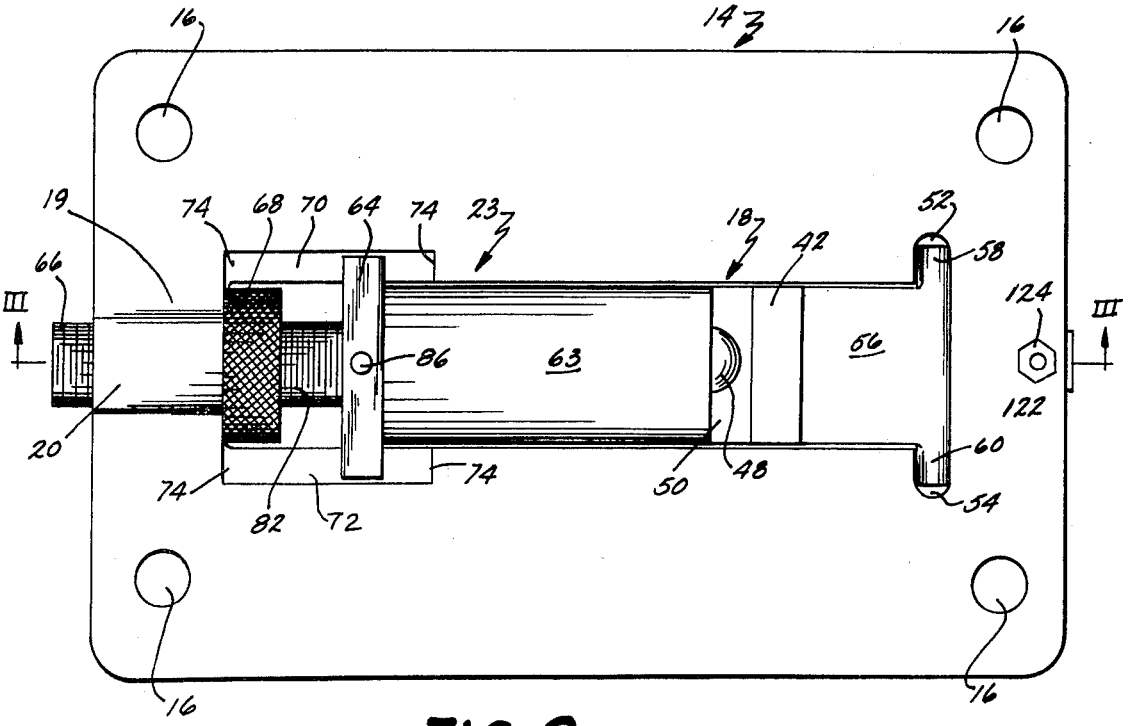
FIG. 2 is a plan view of the tilt mechanism in accordance with the present invention.

The preferred embodiment of a chair tilting mechanism in accordance with the present invention is illustrated in the drawings and designated generally by the reference numeral 10. As shown, the tilting mechanism includes a spindle support or post 12. A tilt plate 14 is pivotally connected to the post 12. The tilt plate includes apertures 16 which serve as attachment points to the underside of a chair or seat (not shown). As best seen in FIG. 2, the tilt plate 14 is formed with a centrally disposed, longitudinally extending slot 18. The forward end of the slot 18 is closed by the cross bar 19. The cross bar, at its center is provided with a fore and aft extending tubular portion 20 providing the clearance opening 22 (FIGS. 3 and 4) having a centerline which is coaxially aligned with the centerline of the longitudinal slot 18. A return torque imparting component 23 is disposed between the post 12 and the tilt plate 14, as more fully described below.

Figure 1:
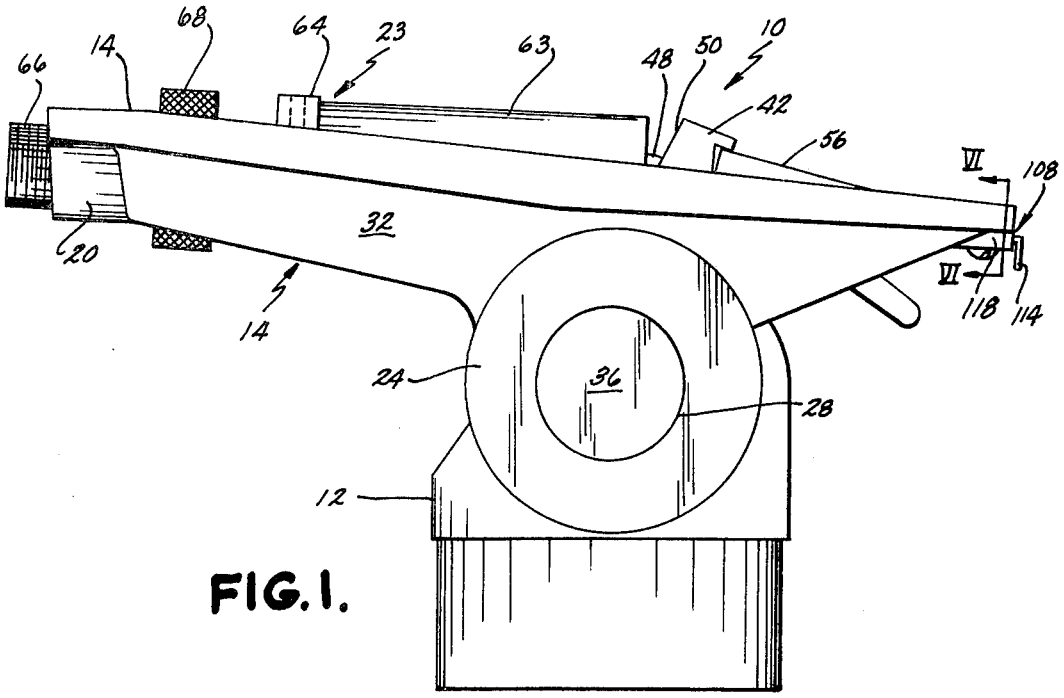
FIG. 1 is a side elevational view of the tilt mechanism in accordance with the present invention.
Figure 3:
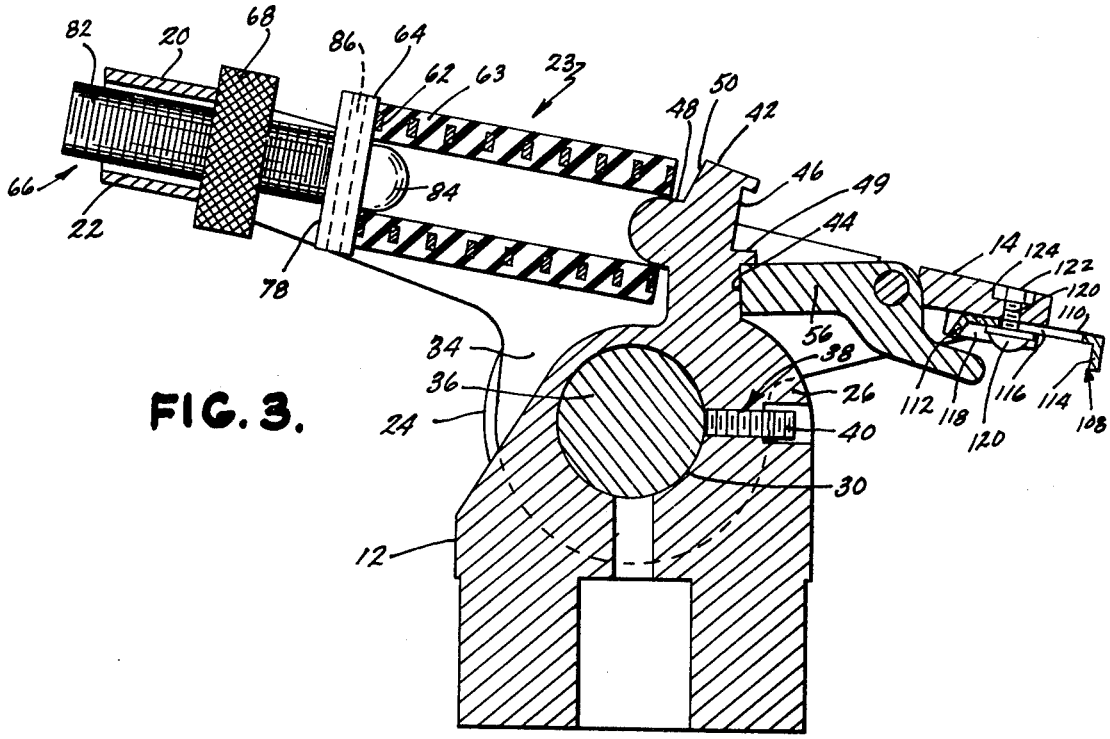
FIGS. 3 and 4 are cross-sectional views taken along line III—III of FIG. 2 showing the mechanism in the standard and special initial positions, respectively.
Figure 4:
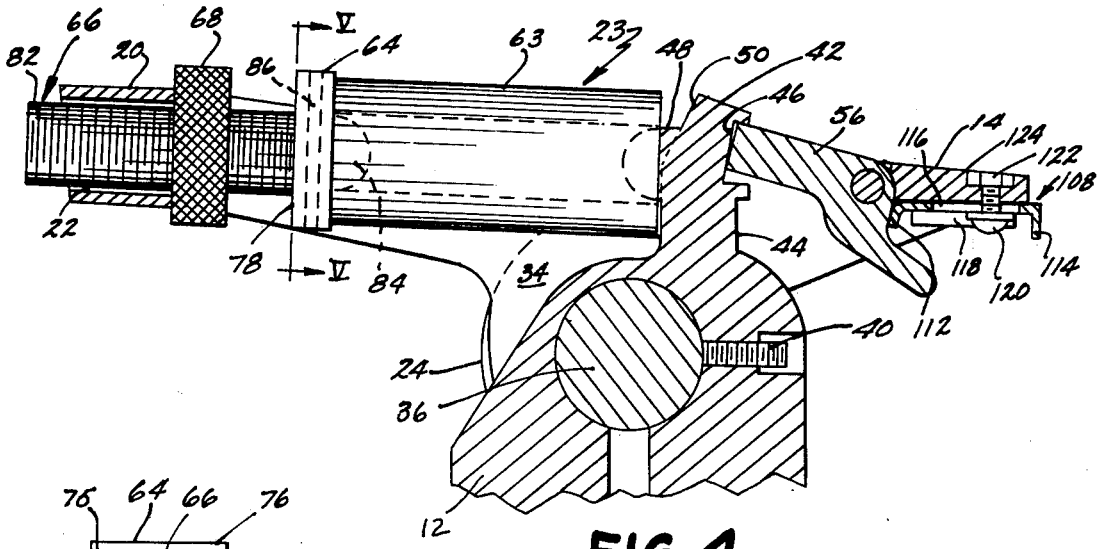

As best seen in FIG. 1, 3 and 4, the support spindle or post 12 is trifurcated at its upper end to define outer pivot pin supports 24 and an intermediate pivot pin support arm 26. Each outer pivot pin support trunnion 24 has an aperture 28 formed therein and the intermediate pivot pin support has an aperture 30 formed therein.

The tilt plate 14 includes a yoke structure 32 on its underside. The tilt plate yoke 32 includes a pair of spaced depending hinge ears or webs 34 having apertures formed therein. A pivot pin 36 extends through webs 34 and is supported by the outer pivot pin support trunnions 24 and the intermediate pivot pin support arm 26 of the post 12. The yoke 32 and the tilt plate 14 is thereby pivotally supported on the trifurcated spindle support or post 12. The support arm 26 is provided with an internally threaded bore 38 adapted to receive a set screw 40. The set screw 40 locks the pivot pin 36 against both rotational and axial movement with respect to the post 12.

As best seen in FIGS. 3 and 4, the support arm 26 includes an integral, upstanding stop finger 42. The stop finger extends upwardly through the longitudinal slot 18 of the tilt plate 14. The rear face of the stop finger is provided with a lower, standard position stop socket 44 and an upper, special, forward tilt or erect position stop socket 46. The two sockets are separated by a rearwardly extending wall 49. The forward face of the stop finger 42 includes a centrally disposed, semi-spherical boss or projection 48. Further, the upper portion 50 of the forward face of the stop finger 42 is upwardly and rearwardly inclined or beveled with the bottom of the bevel being approximately at the center of the boss (FIGS. 3 and 4).

As seen in FIG. 2, the rear end of the longitudinal slot 18 of the tilt plate 14 is formed with semi-cylindrical, latch pin slots 52 and 54. These slots open through the upper face of the plate. A stop and release latch 56 having pins 58 and 60 is pivotally supported on a tilt plate 14 with the pins seated in the slots 52 and 54. As a result, the forward end of the latch 56 may be positioned so as to enter either the standard position stop socket 44 or the special position stop socket 46 in the rear face of the stop finger 42. This is best seen in FIGS. 3 and 4, respectively. As shown, when the stop latch 56 abuts either of the stop sockets 44 or 46, further counterclockwise rotational or forward pivotal movement of the tilt plate 14 is prevented.

Figure 6:
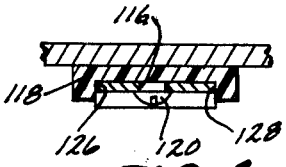
FIG. 6 is a fragmentary sectional view taken along the line VI—VI of FIG. 1.

As best seen in FIGS. 2, 3 and 6, a slidable latch retainer assembly 108 is secured to the underside of the tilt plate 14 adjacent the rear edge thereof. This latch retainer insures that the latch 56 engages the special socket 46 upon return movement from a tilted position and when shifted permits the latch to pivot under its own weight to the standard position.

The retainer assembly includes a slidable member 110 having depending from and rear tabs 112, 114, respectively. The member 110 is formed with a centrally disposed, elongated slot 116. A guide block 118 secured to the tilt plate and having depending sides 126 and 128 prevents sideways movement of the tabbed member 110. A bolt 120 extending through slot 116 slidably secures the member 110 to the tilt plate. A nut 122 threads to the bolt within countersink 129. In the alternative, a headed pin could be used to slidably mount the member 110 to the tilt plate.

As shown in FIG. 3, when the normal position is desired, the user merely grasps tab 114 and slides the member 110 outwardly, permitting the latch 56 to assume its lower socket engaging position. The latch will rotate to this position under the action of gravity. When the forward tilt position is desired, member 110 is pushed in, as shown in FIG. 4, thereby preventing rotation of the latch 56.

When the latch 56 abuts the standard position stop socket 44, the tilt plate 14 assumes the rearwardly inclined position illustrated in FIG. 3. However, when the stop latch 56 engages the special position stop socket 46, the tilt plate is permitted to rotate forwardly through a greater angle, as shown in FIG. 4. This dual position feature of the chair tilting mechanism, permits the chair to be readily adapted for special or specific uses as typing, drafting or laboratory use, or any use requiring a person to assume a more erect position. This feature obviates the need for employing different tilt mechanisms in chairs or seats manufactured for such special or specific uses. This feature also permits the same chair to be adapted to both types of uses, those requiring an erect posture and those requiring a tilted posture. The changeover can be made almost instantly. This feature also results in a reduction in manufacturing costs since a manufacturer may employ a modular approach utilizing the same chair tilting mechanism with different chairs and bases.

Figure 5:
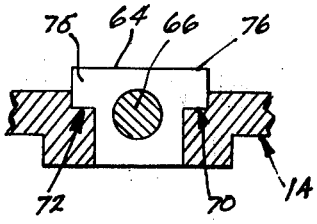
FIG. 5 is a fragmentary sectional view taken along the line V—V of FIG. 4.

The return torque imparting component 23 employs a coil spring 62, encapsulated by a plastic material 63, a spring support block 64, an adjustment shaft or compression stud 66, and a knurled, spring preload, adjustment nut 68. A pair of tracks or guides 70 and 72 are formed in the tilt plate 14 at the forward end of the longitudinally extending slot 18 (FIG. 2). Both tracks 70 and 72 have abutment surfaces 74 at each end. The spring support block 64 is generally T-shaped and dimensioned so that the ears 75 and 76 of the block 64 rest on tracks 70 and 72 (FIG. 5). The support block is, therefore, retained against rotational movement about its longitudinal axis by the tilt plate 14. Longitudinal movement is limited by the abutment surfaces 74. Further, the support block 64 is formed with a longitudinally extending aperture 78 in its depending leg.

The adjustment shaft 66 includes a threaded portion 82 with a smooth, rounded nose portion 84 at its rearward end. The adjustment shaft 66 is disposed within the clearance opening 22 and passes through the opening 22. The nose 84 projects rearwardly beyond the support block 64. A vertical pin 86 (FIGS. 2 and 4) secures the support block to the adjustment shaft. This arrangement holds the adjustment shaft against rotation and prevents axial movement of the shaft relative to the support block.

The knurled adjustment not 68 is threadably disposed on the adjustment shaft 66 with its forward face seated against the cross bar 19. As a result, rotation of the adjustment nut 68 is converted into longitudinal movement of the adjustment shaft 66. This permits preloading of the coil spring 62 since it is confined between the spring support block 64 and the stop finger 42. The coil spring 62 is of the linear reaction type having flattened ends. It is embedded in a matrix of compressible, fatigue resistant plastic. A suitable plastic for this purpose is a urethane having a Durometer of Shore A 85, a 100% modular at 800 p.s.i., a 300% modular at 2000 p.s.i., an elongation of 570% and a tensile strength of 6000 p.s.i. The result is a tubular member in which only the coils are enclosed, the center being open. An exemplary spring suitable for use with this invention is one of 0.100 inch thick flat wire formed into six active coils of 1 inch O. D. and one-half inch I.D. forming a spring 2.45 inches long.

The projection 48 of the stop finger is seated in the end of the plastic encapsulated spring 62 and serves as a pivot point about which the spring 62 rocks as the tilt plate is pivoted. The beveled portion 50 of the stop finger 42 provides clearance for the end of the coiled spring 62 during this rocking movement.

The initial preload of the plastic encapsulated coil spring 62 may be readily adjusted by rotation of the knurled nut 68. The construction of this invention permits the preload to be adjusted within the range of 100–550 inch pounds. This permits a specific coil spring to be adapted to a wide range of different weights possessed by different people using the seat. By varying the initial preload, many people are able to adjust the chair to provide for them a smooth, comfortable ride on the chair. At full 15° tilt the spring can exert a resistance of 400 to 1300 inch pounds.

The overall structural arrangement of the tilting mechanism is compact and has a pleasing exterior appearance. Due to the fact that the coil spring is encapsulated with a plastic material 63, the unsightliness of an exposed coil spring is avoided. Further, the plastic material 63 forms a smooth surfaced tube which is easily cleaned and is not prone to the collection of dust and dirt as are conventional springs. Occupying the space between the coils of the plastic positively prevents anyone from getting his fingers crushed between the coils.

The tilting mechanism of the subject invention is readily adaptable to satisfy the requirements of a wide population of people having vastly different physical characteristics, due to the fact that the arrangement readily permits substitution of coil springs having higher or lower spring rates. By tilting the seat and, hence, the pivot plate 14 backwardly and, at the same time, pivoting the stop and release latch so that it is disengaged from the stop sockets, the seat is free to pivot substantially beyond its normal forward position. This changes the effective length between the cross bar 19 and the stop finger 42. Thus, with the latch 56 released and the seat tilted to a forwardly inclined position the spring 23 will normally drop out into the operator's hand. This provides easy access to the spring by a user permitting ready substitution. Conventional coil spring tilting mechanisms, are generally so constructed as to prevent spring substitution at the customer level except with the use of special tools or after dismantling the mechanism. Alternately, the entire tilting mechanism is enclosed by a separate housing which does not permit ready access to the coil spring. These problems are eliminated by the present invention. No separate housing is employed. An aesthetically improved appearance is provided.

Since the encapsulated coil spring 62 seats against the support block 64, a direct bearing between the adjustment nut 68 and the coil spring is avoided. This feature permits easy preloading of the device by a user without the necessity of special tools since the area of frictional contact between the face of the adjustment nut and the clearance housing 20 is substantially less than would be the case with an arrangement whereby the rotatable adjustment element bears directly on the end of a coil spring as in conventional tilting mechanisms. Further, all frictional resistance can be eliminated by releasing the latch, tipping the seat forward and making the adjustment while the spring is loose but still spindled between the boss 48 nd the rear end of the shaft 66.

The tilt plate 14 may be made from various materials such as aluminum. The coil springs are preferably made from flat, steel wire having the ends closed and ground. While a preferred encapsulation material of a resilient plastic material has been described, other encapsulating materials may be employed, such as rubber. Whatever material is chosen must have excellent fatigue resistance characteristics, must be capable of adherence to the spring and sufficiently resilient that it will not interfere with the action of the spring. Another primary criteria of this material is one which is easily cleaned and which is pleasant in appearance. It has been found to be highly desirable to incorporate an encapsulated coil spring in the tilting mechanism which possesses linear characteristics at the minimum preload conditions, but which possesses an increased spring rate when subjected to maximum preload conditions. Such a spring provides the tilting mechanism with the ability to satisfy the need of a wider range of body weights. Such characteristics prevent lighter weight people from experiencing a build-up of force as they tilt back in the chair and prevent heavy weight people from experiencing a sinking feeling as they tilt back. This avoids the occurrence of any surprising or fatiguing subjective impressions in a greater range of population.

Thus, it will be appreciated that the present invention provides a tilting mechanism for a chair possessing the qualities of compact size, low weight, relatively low cost, as well as ease of adjustment and maintenance. It is expressly intended, therefore, that the foregoing description is illustrative of the preferred embodiment only and is not to be considered limiting. The true spirit and scope of the present invention will be determined by reference to the appended claims.

The embodiments of the invention in which an exclusive property or privilege is claimed are defined as follows:

1. A chair tilting mechanism having a vertical spindle support and a tilt plate extending in a plane laterally from and at right angles to said spindle support and pivotally carried by said spindle support; stop means carried by said tilt plate and cooperating with said spindle support for limiting forward pivotal movement of said tilt plate relative to said spindle support, the improvement in said mechanism comprising: an encapsulated, coil spring operatively connected between said spindle support and said tilt plate and having its central axis generally parallel to and substantially in the plane of said tilt plate for providing a return torque opposing backward pivotal movement of said tilt plate.

2. A chair tilting mechanism as defined by claim 1 wherein said spindle support includes an up standing stationary, rigid stop finger, said stop finger having on its forward face a centrally disposed projection adapted to receive an end of said encapsulating coil spring; a spring support block slidably carried on said tilt plate and abutting the other end of said encapsulated coil spring; and an adjustment shaft connected to said spring support block.

3. A chair tilting mechanism as defined by claim 2 wherein said tilt plate has a longitudinally extending slot and a pair of longitudinally extending tracks adjacent said slot at the forward end of said slot; said support block having a generally T-shape and adapted to extend through said longitudinal slot and be supported on said tracks.

4. A chair tilting mechanism as defined by claim 3 wherein said tilt plate has a clearance housing defining a longitudinally extending opening in line with said longitudinally extending slot of said tilt plate and through which said adjustment shaft extends.

5. A chair tilting mechanism as defined by claim 4 further including an adjustment nut threadably disposed on said adjustment shaft between said support block and said clearance housing.

6. A chair tilting mechanism as defined by claim 1 wherein said tilt plate further includes a depending yoke having depending webs, said webs having apertures formed therein, said spindle support further including a trifurcated end having apertured upstanding pivot supports and a pivot pin extending through said apertures of said pivot supports and said depending webs; the third upstanding element of said trifurcated end being a stop finger extending through said tilt plate and providing the spindle connection for the spring.

7. A tilt mechanism for mounting a seat, said mechanism having a base member and a generally planar seat attachment member and pivot means pivotally securing said seat attachment member to the top of said base member, means providing resilient resistance to rearward pivotal movement of said seat attachment member, said means comprising: a fore and aft extending slot in said seat attachment member; a stationary shoulder secured to said base member and located in said slot; an abutment member on said seat attachment member; a compression spring seated in said slot and generally in the plane of said seat attachment member and between and abutting against said shoulder and abutment member of biasing said seat attachment member forwardly; disengageable means for limiting forward pivotal movement of said seat at a position where said spring is compressively loaded; said spring abutting said shoulder at a point spaced radially from said pivot means whereby upon disengagement of said disengageable means and forward pivotal movement of said seat attachment member beyond the normal at rest position thereof, the spacing between said shoulder and said abutment member is increased and said spring is released.

8. A tilt mechanism as described in claim 7 wherein the coils of said spring are encapsulated in a matrix of resilient, flexible plastic of generally tubular cross section.

9. The tilt mechanism described in claim 8 wherein said spring is seated in the forward portion of said slot; a spring preload adjustment member at the forward end of said slot and means for shifting said adjustment member fore and aft for varying the preload applied to said spring.

10. A tilt mechanism for mounting a seat, said mechanism having an upstanding base member and a seat attachment member extending in a plane laterally from the vertical axis of said base member and pivot means pivotally securing said seat attachment member to the top of said base member, means providing resilient resistance to rearward pivotal movement of said seat attachment member, said means being a compression spring; a slot in the forward end of said seat attachment member for receiving the upper end of said base member and said spring, said spring being generally in said plane of said seat attachment member; adjustable means at the forward end of said slot bearing against the forward end of said spring; said adjustable means having sliding engagement with said seat attachment member; a stationary boss on said base projecting into said slot, the rear end of said spring being seated against the forward face of said boss; means for limiting the forward tilting movement of said seat attachment member.

11. A tilt mechanism for mounting a seat as described in claim 10 wherein said spring is encapsulated in a matrix of a flexible, compressible, fatigue resistant plastic material, which material does not materially change the spring rate value of the spring.

12. A tilt mechanism for mounting a seat as described in claim 10 wherein said encapsulation matrix is of a tubular cross section.

13. A tilt mechanism for mounting a seat as described in claim 10 wherein said spring and its encapsulating matrix cooperatively provide a spring action which is generally linear throughout substantially the entire operating range of said spring.

* * * * *